US005227841A

United States Patent [19]

Takahashi et al.

[11] Patent Number: 5,227,841

[45] Date of Patent: Jul. 13, 1993

[54] IMAGE FORMING APPARATUS HAVING UNIT SUPPORT MEMBER THEREON

[75] Inventors: Tomohiko Takahashi; Hidetoshi Aoki, both of Yokohama, Japan

[73] Assignee: Kabushiki Kaisha Toshiba, Kawasaki, Japan

[21] Appl. No.: 860,576

[22] Filed: Mar. 30, 1992

Related U.S. Application Data

[63] Continuation of Ser. No. 620,737, Dec. 3, 1990, abandoned.

[30] Foreign Application Priority Data

Dec. 4, 1989 [JP] Japan ..... 1-315105

[51] Int. Cl.[5] ..... G03G 15/00

[52] U.S. Cl. ..... 355/200; 355/271; 355/309

[58] Field of Search ..... 355/200, 210, 211, 260, 355/245, 271, 274, 219, 308, 309

[56] References Cited

U.S. PATENT DOCUMENTS 4,412,734 11/1983 Shibuya et al. ..... 355/200 X
4,456,363 6/1984 Hirabayashi ..... 355/200 X
4,585,324 4/1986 Koyama et al. ..... 355/200 X
4,702,587 10/1987 Miyoshi ..... 355/200 X
4,803,510 2/1989 Maeda ..... 355/200 X
4,806,967 2/1989 Newbury ..... 355/200 X
4,862,212 8/1989 Tanzawa et al. ..... 355/260 X
4,926,219 5/1990 Hirasawa et al. ..... 355/309
4,984,018 1/1991 Andou et al. ..... 355/200

FOREIGN PATENT DOCUMENTS 0139764 11/1982 Japan ..... 355/200

*Primary Examiner*—A. T. Grimley
*Assistant Examiner*—Thu Dang
*Attorney, Agent, or Firm*—Foley & Lardner

[57] ABSTRACT

An image forming apparatus includes a photoconductive drum and an image forming mechanism for forming a toner image on the drum. A transfer charger for transferring the toner image onto a paper is arranged to oppose the drum. A unit member is arranged to face the drum, and integrally provided with first and second support portions and first and second paper guides. The transfer charger is supported on the first support portion, and an aligning roller for feeding paper to the transfer charger is supported on the second support portion. The paper fed by the aligning roller is guided by the first guide to a position between the drum and the transfer charger, and is further guided by the second paper guide toward a fixing unit.

2 Claims, 4 Drawing Sheets

IMAGE FORMING APPARATUS HAVING UNIT SUPPORT MEMBER THEREON

This application is a continuation of application Ser. No. 07/620,737, filed Dec. 3, 1990, now abandoned.

BACKGROUND OF THE INVENTION

1. Field of the Invention

The present invention relates to an image forming apparatus such as an electrophotographic copying machine, a laser printer, and the like, for forming an image by using an electrophotographic process.

2. Description of the Related Art

In an image forming apparatus such as an electrophotographic copying machine or a laser printer, after a developing agent image (toner image) is formed on a photoconductive drum as an image carrier, the developing agent image is transferred, by transfer means, onto a transfer medium, such as plain paper, which is conveyed along a convey path. The transfer medium is then guided to a fixing unit.

In a conventional copying machine, all the following components are constituted by separate members: a holding member for holding the transfer means; a support member for supporting feeding means for feeding a transfer medium to the transfer means; a guide for guiding the transfer medium fed by the feeding means to a position between the transfer means and the photoconductive drum; and a guide for guiding the transfer medium on which a developing agent image is transferred to the fixing unit.

If, however, a series of the components arranged along the convey path are constituted by separate members as described above, it is difficult to position the respective members with high precision. Moreover, the assembly performance is impaired, and the manufacturing cost is undesirably increased.

SUMMARY OF THE INVENTION

The present invention has been made in consideration of the above situation, and has as its object to provide an image forming apparatus in which the positional relationship among a series of members arranged along a convey path for a transfer medium can be maintained with high precision so as to allow formation of an image of good quality, and the number of components can be decreased to improve the assembly performance and to decrease the manufacturing cost.

In order to achieve the above object, according to the present invention, there is provided an image forming apparatus comprising means for forming a developing agent image on an image carrier, means for transferring the developing agent image onto a transfer medium, means for fixing the transferred image onto the transfer medium, means for feeding a transfer medium to the transferring means, and a unit member provided on a body of the image forming apparatus and having a first support portion for supporting the transferring means, a second support portion for supporting the feeding means, first guide means for guiding the transfer medium, which is fed by the feeding means, to a position between the image carrier and the transferring means, and second guide means for guiding the transfer medium, which passed through the transferring means, to the fixing means.

According to the image forming apparatus having the above-described arrangement, a series of members arranged along a convey path for transfer mediums, i.e., the first support portion for supporting the transferring means, the first and second guides, and the second support portion for supporting part of the convey means, are integrally formed as the unit member. With this arrangement, in comparison with the case wherein such a series of members are constituted by separate members, the relative positions of the respective members can be maintained with high precision, and an image having excellent quality can be formed. In addition, a decrease in number of components enables an improvement in assembly performance and a reduction in manufacturing cost.

In addition, according to the image forming apparatus of the present invention, the transferring means has a transfer charger having a charging wire, and the unit member includes a terminal portion for supporting the charging wire of the transfer charger.

With this arrangement, no independent terminal block for supporting the charging wire of the transfer charger is required, and hence the manufacturing cost of the apparatus can be further reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 4 show an image forming apparatus according to an embodiment of the present invention, in which:

FIG. 1 is a sectional view showing the overall apparatus,

FIG. 2 is an enlarged sectional view showing an essential part of the apparatus, FIG. 3 is an enlarged sectional view of a unit member, and FIG. 4 is a plan view of the unit member; and FIGS. 5 and 6 show a modification of the unit member, in which:

FIG. 5 is an enlarged sectional view of the unit member, and

FIG. 6 is an exploded perspective view showing a part of the unit member.

DETAILED DESCRIPTION OF THE PREFERRED EMBODIMENT

An embodiment of the present invention will be described with reference to FIGS. 1 to 4.

Figure 1:
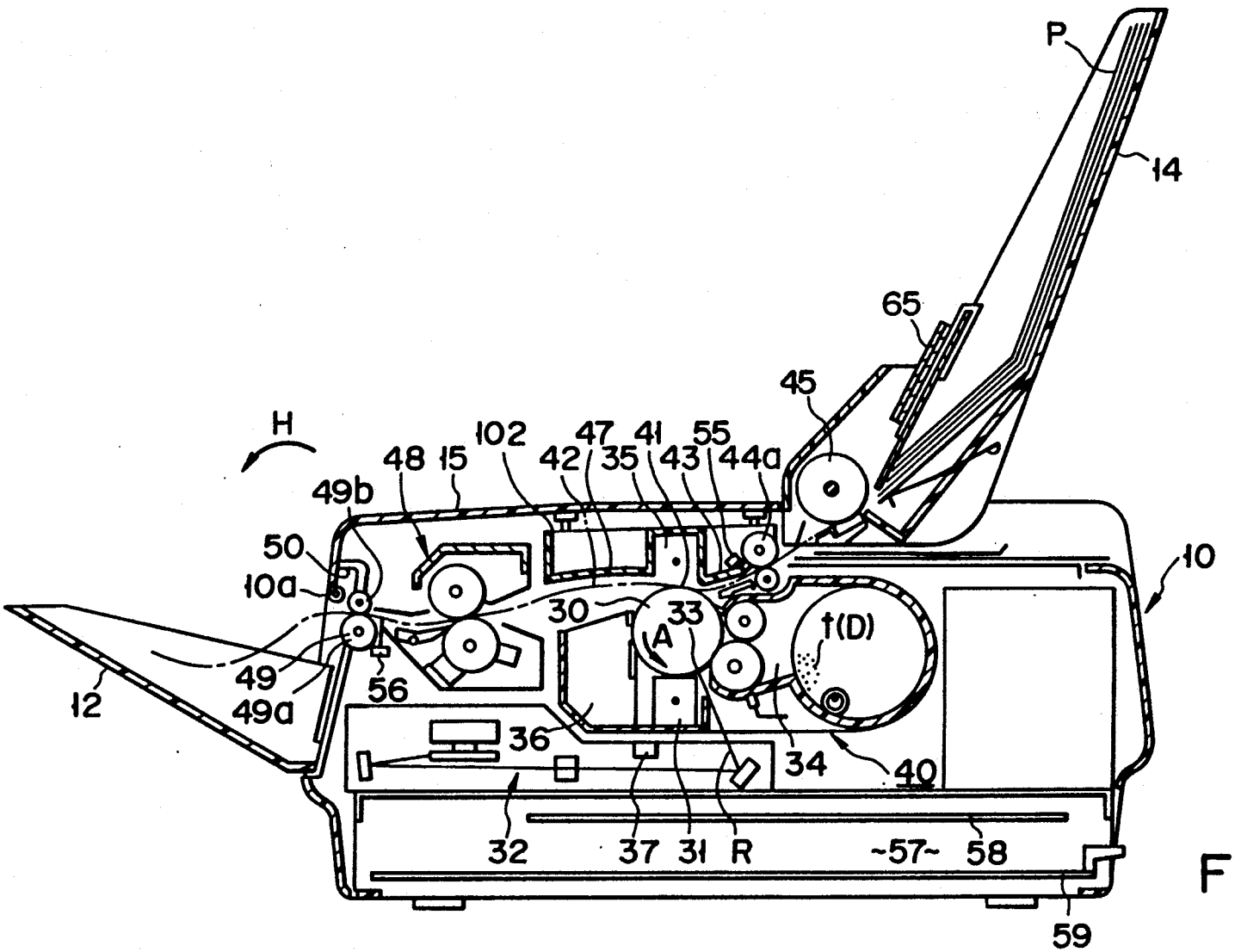

As shown in FIG. 1, a laser printer as an image forming apparatus according to this embodiment includes an apparatus main body 10. The main body 10 has the following arrangement. A detachable paper discharge tray 12 is arranged on a front portion of the main body 10. A paper cassette 14 for storing sheets of paper P as a transfer medium is mounted on an upper portion of the main body 10.

Figure 2:
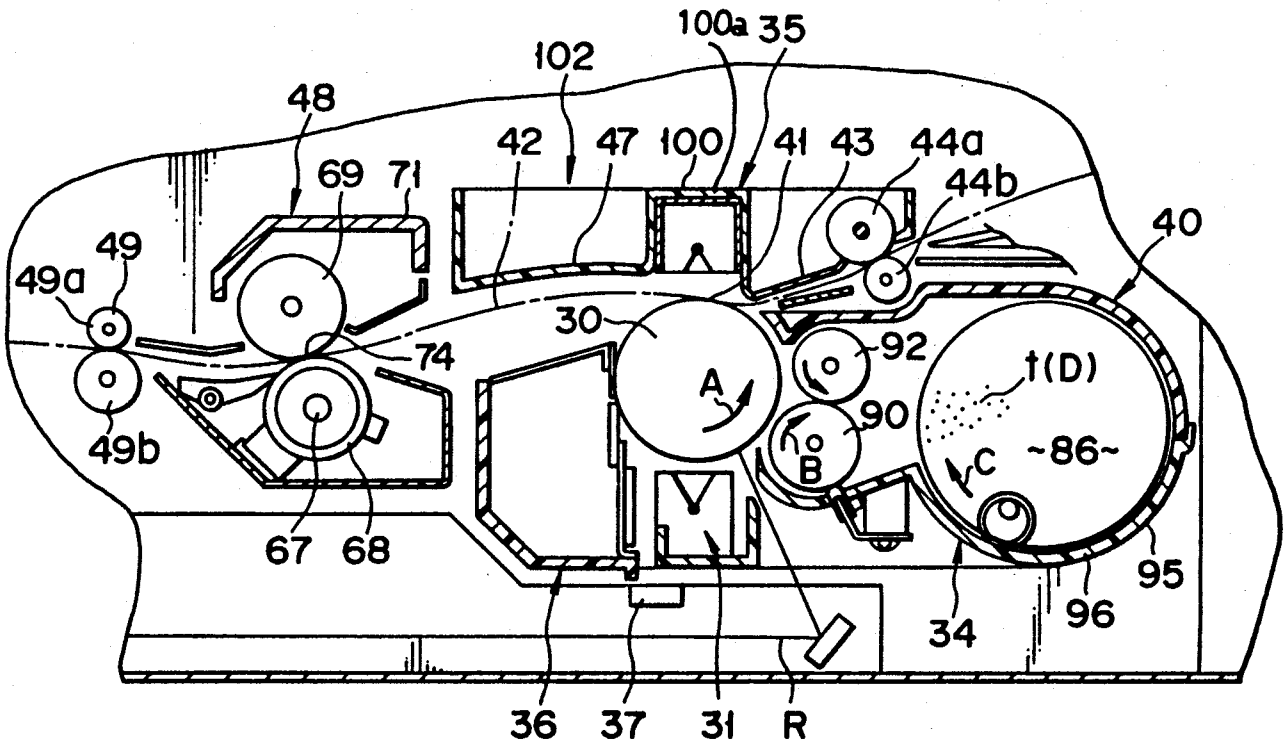
Figure 3:
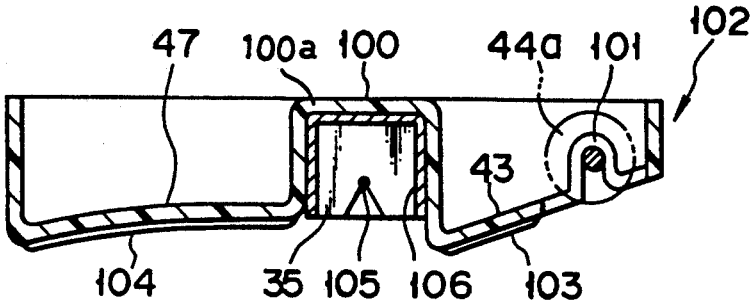

As shown in FIGS. 1 and 2, a photoconductive drum 30 as an image carrier is rotatably arranged in the main body 10. The following components are sequentially arranged around the drum 30 in a rotating direction thereof indicated by an arrow A: a charger 31 constituted by a Scorotron; an exposure portion 33 for receiving laser beam R emitted from a laser exposure unit 32 as an electrostatic latent image forming means; a non-magnetic one-component developing unit 34; a transfer charger 35, as transferring means, formed of a Corotron; a drum cleaner 36; and a pre-exposure unit 37.

Of these components, the photoconductive drum 30, the charger 31, the developing unit 34, and the drum cleaner 36 are formed into a unit to constitute an image forming process cartridge 40 detachably mounted in the apparatus main body 10. The developing unit 34 includes a casing 96 constituting a frame 95 of the process cartridge 40. A developing roller 90, a sponge roller 92, toner t, and the like are housed in this casing 96. The drum 30, the charger 31, and the cleaner 36 are attached to the frame 95.

This process cartridge 40 is replaced with a new one after it is used for printing of a predetermined number of sheets of paper.

In the main body 10 is defined a paper convey path 42 for guiding paper P supplied from the paper cassette 14 to the paper discharge tray 12 through an image transfer portion 41 formed between the drum 30 and the transfer charger 35. On the upstream side of the image transfer portion 41 on the convey path 42, a pair of aligning rollers 44*a* and 44*b* as feeding convey means, a pickup roller 45, and the paper cassette 14 are arranged in this order. On the downstream side of the image transfer portion 41, a heat roller type fixing unit 48 and a pair of paper discharge rollers 49 are arranged.

The fixing unit 48 comprises a heat roller 68 incorporating a heater lamp 67, and a pressing roller 69 urged against the roller 68. When a paper P having a toner image formed thereon passes between these rollers 68 and 69, the toner image is melted/fixed on the paper P. The rollers 68 and 69 are enclosed within lower and upper casings 70 and 71 to ensure the temperature and atmosphere required for a fixing operation.

The paper discharge rollers 49 are constituted by lower and upper rollers 49*a* and 49*b*. In addition, a discharge brush 50, which is brought into contact with a non-image formation surface side of the paper P is arranged near the discharge rollers 49.

Figure 4:
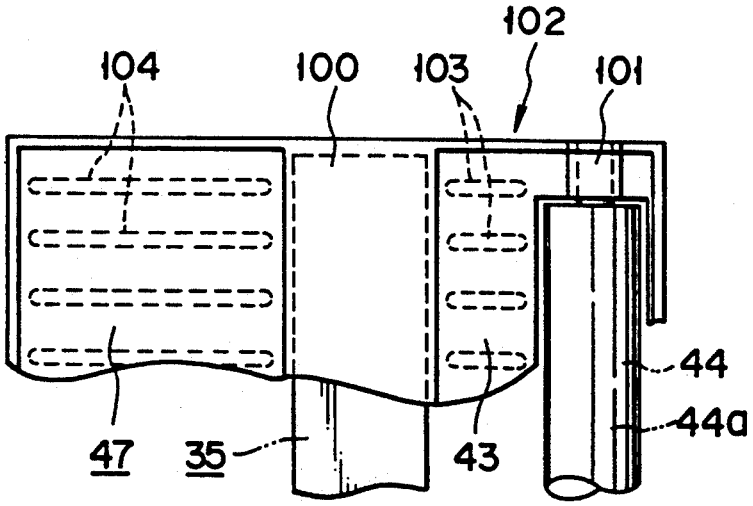

A unit member 102 is arranged above the photoconductive drum 30 along the convey path 42. As shown in FIGS. 2 and 4, the unit member 102 includes a first support portion 100 for holding the transfer charger 35. The support portion 100 includes a support member 100*a* formed into an elongated rectangular box extending in the axial direction of the drum 30. The bottom of the support member 100*a* is open to the drum 30. The transfer charger 35 includes a charging wire 105 extending parallel to the axis of the drum 30, and a rectangular shield case 106 holding and enclosing the wire 105. The support member 100*a* has the same shape as the outer shape of the shield case 106. The transfer charger 35 is held by the unit member 102 while the shield case 106 is fitted in the support member 100*a*.

A pair of second support portions 101 (only one of them is shown) constituted by recesses open downward are formed in an end portion of the unit member 102 on the paper cassette 14 side. Two axial end portions of the upper aligning roller 44*a* are rotatably fitted in the second support portions. The unit member 102 further comprises a first paper guide 43 extending from the support member 100*a* to the second support portions 101, and a second paper guide 47 extending from the support member 100*a* toward the fixing unit 48. The first paper guide 43 defines part of the convey path 42 and guides the paper P, which is fed by the aligning rollers 44*a* and 44*b*, to a position between the transfer charger 35 and the photoconductive drum 30. The second guide 47 defines part of the convey path 42 and guides the paper P, which passes through the image transfer portion 41, toward the fixing unit 48. A plurality of ribs 103 extending in the paper convey direction are formed on the lower surface of the first guide 43. Similarly, a plurality of ribs 104 extending along the paper convey path are formed on the lower surface of the second guide 47.

The unit member 102 having the above-described arrangement is integrally molded by a resin having excellent heat resistance and durability and is fixed to the inner surface of an upper cover 15 (to be described later) of the apparatus main body 10.

As shown in FIG. 1, the upper surface portion of the apparatus main body 10 is constituted by the upper cover 15. This cover 15 can be pivoted through a maximum angle of 180° in a direction indicated by an arrow H around a pivotal portion 10*a* located at the left end portion of the main body 10. The unit member 102, the upper roller 49*b* of the paper discharge roller pair 49, and the discharge brush 50 are mounted on the inner surface of the cover 15.

When the upper cover 15 is pivoted upward, the unit member 102, the upper roller 49*b*, and the discharge brush 50 are greatly displaced upward and outward. With this operation, most of the paper covey path 42 and most of components in the image forming process cartridge 40 opposing the paper convey path 42 are exposed. For this reason, removal of the paper P upon jamming and maintenance/inspection and replacement of the above-mentioned components can be easily and efficiently performed.

A paper empty switch (not shown) for detecting sheets of paper P in the paper cassette 14 is arranged near the pickup roller 45. In addition, an aligning switch 55 and a paper discharge switch 56 are respectively arranged near the aligning rollers 44*a* and 44*b* and the paper discharge rollers 49 so as to detect the paper P.

A control board 58 on which a control circuit is mounted is arranged in a board storage portion 57 together with a printer control board 59 on which a printer control circuit is mounted. The board storage portion 57 is formed in a lower portion of the apparatus main body 10. The control circuit controls each electric device arranged in the main body 10 to control execution of an electrophotographic process. The printer control circuit controls an operation of the control board 58.

When an image forming operation of the laser printer having the above-described arrangement is to be performed, the photoconductive drum 30 is rotated and the surface potential of the drum 30 is kept constant by the pre-exposure unit 37. Then, the surface of the drum 30 is uniformly charged by the charger 31. Subsequently, the surface of the drum 30 is scanned/exposed with the laser beam R emitted from the laser exposure unit 32. As a result, an electrostatic latent image corresponding to an image signal is formed on the drum surface.

The formed electrostatic latent image is developed by the developing unit 34 using a one-component developing agent D consisting of the toner t. The developed image, i.e., a toner image is supplied to the image transfer portion 41.

In synchronism with the toner image forming operation, a paper P is picked up from the paper cassette 14 or is manually supplied from a manual insertion guide 65. The paper is then conveyed to the image transfer portion 41 through the aligning rollers 44*a* and 44*b* and the first paper guide 43 of the unit member 102. The toner image formed on the photoconductive drum 30 in advance is transferred onto the paper P by the transfer charger 35. Subsequently, the paper P is guided by the second paper guide 47 of the unit member 102 and conveyed to the fixing unit 48 through the paper convey path 42. In the fixing unit 48, the toner image is melted/fixed on the paper P. Thereafter, the paper P is discharged to the paper discharge tray 12 through the paper discharge rollers 49.

Note that after the toner image is transferred onto the paper P, the residual toner on the drum 30 is removed by the drum cleaner 36.

According to the laser printer having the above-described arrangement, the unit member 102 is formed with the first and second support portions 100 and 101, and the first and second paper guides 43 and 47, which are arranged along the convey path 42. In this arrangement, the relative positions of the upper aligning roller 44*a*, the transfer charger 35, and the first and second guides 43 and 47 can be maintained with high precision in comparison with the case wherein these components are constituted by separate members. Therefore, the paper P can be stably conveyed, and an image having excellent quality can be formed. In addition, since the number of components can be decreased, the assembly performance can be improved, and the manufacturing cost can be reduced.

The present invention is not limited to the above-described embodiment. Various changes and modifications can be made within the spirit and scope of the invention.

Figure 5:
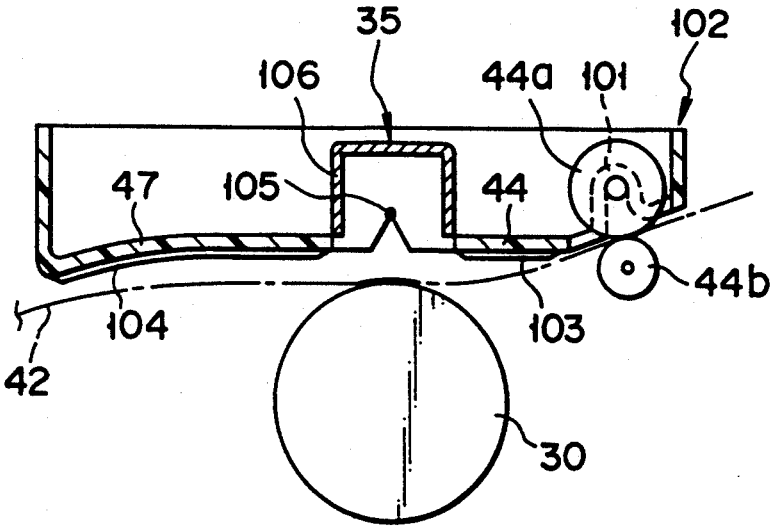
Figure 6:
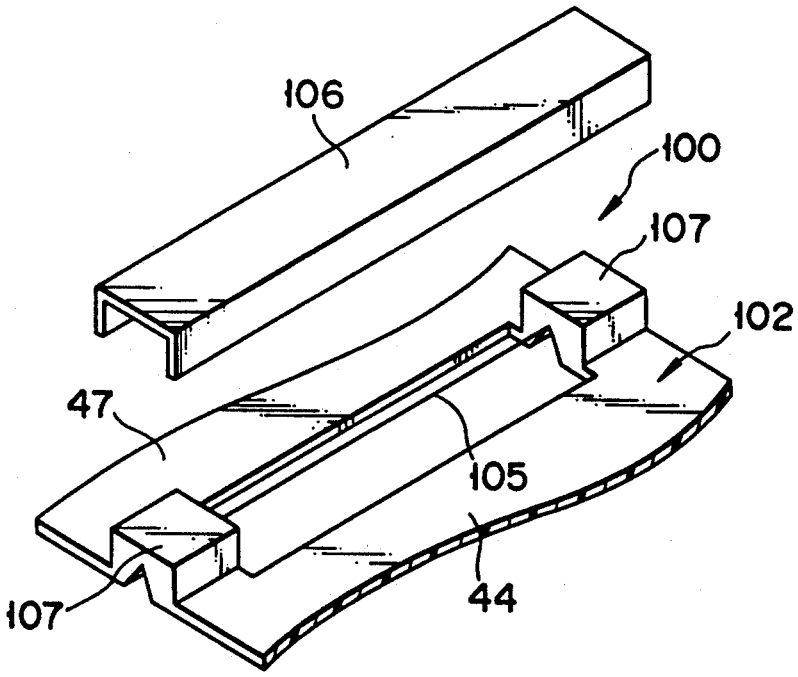

For example, as shown in FIGS. 5 and 6, the first support portion 100 of the unit member 102 may be constituted by a pair of terminal blocks 107 which support the two ends of the charging wire 105 of the transfer charger 35. These blocks are integrally molded together with the first and second guides 43 and 47. In this case, the shield case 106 of the transfer charger 35 is held by the unit member 102 while the two end portions of the case 106 are fitted on the blocks 107 from the above.

In such a modification, the same effects as those in the above embodiment can be obtained, and the manufacturing cost can be further reduced.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. An image forming apparatus comprising:

an apparatus main body;

a process cartridge removably arranged in the main body, said process cartridge having a rotatable image carrier, and means for forming an image on said image carrier;

means arranged to face the image carrier, for transferring the image formed on the image carrier by the forming means of the process cartridge onto a transfer medium;

means for fixing the transferred image to the transfer medium;

means for feeding a transfer medium through a position between the image carrier and the transferring means; and a support member made of resin by molding, attached to the main body, and including a bottom wall opposing said image carrier, a first recess formed on the bottom wall and in which the transferring means is fitted to face the image carrier, a second recess formed on the bottom wall, for supporting said feeding means, a first guide means defined by the bottom wall and located between the first and second recesses for guiding the transfer medium fed by said feeding means to a position between said image carrier and said transferring means, and a second guide means defined by the bottom wall, for guiding the transfer medium, which has passed through said transferring means, to said fixing means.

2. An image forming apparatus comprising:

an apparatus main body;

means for forming a developing agent image on a rotatable photoconductive drum;

means arranged to face the photoconductive drum, for electrostatically transferring the developing agent image onto a transfer medium;

means for fixing the transferred image onto the transfer medium;

means for feeding a transfer medium to the transferring means, the feeding means including a convey path extending through a position between said photoconductive drum and said transferring means, and an aligning roller, said apparatus main body including a first body portion and a second body portion connected to the first body portion and movable to a position wherein said convey path is exposed to the outside of the main body of the apparatus; and a support member made of resin by molding and including a bottom wall opposing said image carrier, a first recess formed on the bottom wall, for supporting said transferring means, a second recess formed on the bottom wall, for supporting a rotational shaft of the aligning roller, a first guide defined by the bottom wall and located between the first and second recesses, for guiding the transfer medium fed by said feeding means to a position between said image carrier and said transferring means, and a second guide defined by the bottom wall, for guiding the transfer medium, which has passed through said transferring means, to said fixing means, said support member being attached to one of the first and second body portions so that the transferring means faces the photoconductive drum and the first and second guides define the convey path.

* * * * *